US008129924B2

(12) United States Patent
Van Ess et al.

(10) Patent No.: US 8,129,924 B2
(45) Date of Patent: Mar. 6, 2012

(54) STOCHASTIC SIGNAL DENSITY MODULATION FOR OPTICAL TRANSDUCER CONTROL

(75) Inventors: David Van Ess, Arlington, WA (US); Patrick N. Prendergast, Clinton, WA (US)

(73) Assignee: Cypress Semiconductor Corporation, San Jose, CA (US)

( * ) Notice: Subject to any disclaimer, the term of this patent is extended or adjusted under 35 U.S.C. 154(b) by 1200 days.

(21) Appl. No.: 11/598,981

(22) Filed: Nov. 13, 2006

(65) Prior Publication Data

US 2008/0111503 A1 May 15, 2008

(51) Int. Cl.
*G05F 1/00* (2006.01)
*H05B 37/00* (2006.01)

(52) U.S. Cl. ..... 315/307; 315/312

(58) Field of Classification Search ..... 315/307, 315/291, 312; 362/800, 611, 612, 555; 345/690, 345/691, 692, 697, 82, 204
See application file for complete search history.

(56) References Cited

U.S. PATENT DOCUMENTS

| | | | | |
|---|---|---|---|---|
| 4,253,045 | A * | 2/1981 | Weber | 315/210 |
| 4,680,780 | A * | 7/1987 | Agoston et al. | 375/374 |
| 5,065,256 | A * | 11/1991 | Suganuma et al. | 358/3.19 |
| 5,353,122 | A * | 10/1994 | Kim | 358/296 |
| 6,338,765 | B1 * | 1/2002 | Statnikov | 148/558 |
| 6,587,248 | B1 * | 7/2003 | Gyoten | 359/245 |
| 6,628,249 | B1 | 9/2003 | Kamikawa et al. | |
| 6,630,801 | B2 | 10/2003 | Schuurmans | |
| 6,734,875 | B1 * | 5/2004 | Tokimoto et al. | 345/690 |
| 6,807,137 | B2 * | 10/2004 | Chuang | 369/59.24 |
| 6,864,989 | B2 * | 3/2005 | Storz et al. | 356/601 |
| 7,014,336 | B1 | 3/2006 | Ducharme | |
| 7,046,160 | B2 * | 5/2006 | Pederson et al. | 340/815.45 |
| 7,095,439 | B2 * | 8/2006 | Hammadou | 348/308 |
| 7,319,298 | B2 | 1/2008 | Jungwirth et al. | |
| 7,372,902 | B2 * | 5/2008 | Matsushima | 375/238 |
| 7,689,130 | B2 | 3/2010 | Ashdown | |
| 7,712,917 | B2 | 5/2010 | Roberts et al. | |
| 7,868,562 | B2 | 1/2011 | Salsbury et al. | |
| 7,915,838 | B2 | 3/2011 | VanEss | |
| 8,044,612 | B2 | 10/2011 | Prendergast et al. | |
| 8,093,825 | B1 | 1/2012 | Van Ess et al. | |
| 2004/0001040 | A1 * | 1/2004 | Kardach et al. | 345/102 |
| 2006/0033443 | A1 * | 2/2006 | Ishii et al. | 315/87 |
| 2006/0245174 | A1 * | 11/2006 | Ashdown et al. | 362/85 |
| 2007/0267978 | A1 | 11/2007 | Shteynberg | |

OTHER PUBLICATIONS

USPTO Notice of Allowance for U.S. Appl. No. 11/811,108 dated Jun. 24, 2011; 8 pages.
USPTO Notice of Allowance for U.S. Appl. No. 11/811,108 dated Dec. 23, 2010; 4 pages.
USPTO Non-Final Rejection for U.S. Appl. No. 11/811,108 dated Aug. 18, 2010; 6 pages.

* cited by examiner

*Primary Examiner* — Douglas W Owens
*Assistant Examiner* — Minh D A

(57) ABSTRACT

A controller for optical transducers uses stochastic signal density modulation to reduce electromagnetic interference.

28 Claims, 3 Drawing Sheets

300

400

STOCHASTIC SIGNAL DENSITY MODULATION FOR OPTICAL TRANSDUCER CONTROL

TECHNICAL FIELD

Embodiments of the present invention relate to the field of optical transducer control and, in particular, to the use of stochastic modulation waveforms for intensity control of light-emitting diodes.

BACKGROUND

Light-emitting diode (LED) technology has advanced to the point where LEDs can be used as energy efficient replacements for conventional incandescent and/or fluorescent light sources. One application where LEDs have been employed is in ambient lighting systems using white and/or color (e.g., red, green and blue) LEDs. Like incandescent and fluorescent light sources, the average intensity of an LED's output is controlled by the average current through the device. Unlike incandescent and fluorescent light sources, however, LEDs can be switched on and off almost instantaneously. As a result, their intensity can be controlled by switching circuits that switch the device current between two current states to achieve a desired average current corresponding to a desired intensity. This approach can also be used to control the relative intensities of red, green and blue (RGB) LED sources (or any other set of primary colors) in ambient lighting systems that mix primary colors in different ratios to achieve a desired color.

One approach to LED switching is described in U.S. Pat. Nos. 6,016,038 and 6,150,774 of Meuller et al. These patents describe the control of different LEDs with square waves of uniform frequency but independent duty cycles, where the square wave frequency is uniform and the different duty cycles represent variations in the width of the square wave pulses. The Meuller patents describe this as pulse width modulation (PWM). This type of control signal has high spectral content at the uniform frequency and its odd harmonics, which can cause electromagnetic interference (EMI) to sensitive devices, components, circuits and systems nearby.

DETAILED DESCRIPTION

Described herein are methods and apparatus for controlling optical transducers using stochastic signal density modulation. The following description sets forth numerous specific details such as examples of specific systems, components, methods and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the spirit and scope of the present invention.

In one embodiment, a method for controlling an optical transducer includes providing a controllable current to a light-emitting diode and stochastically controlling the current to select a light intensity output from the light-emitting diode. In one embodiment, an apparatus for controlling an optical transducer includes a controllable current supply coupled to a light-emitting diode and a controller coupled to the controllable current supply, where the controller is configured to provide a stochastic control signal to the controllable current supply and where the stochastic control signal has a selected stochastic signal density to control the output intensity of the light-emitting diode.

Figure 1:
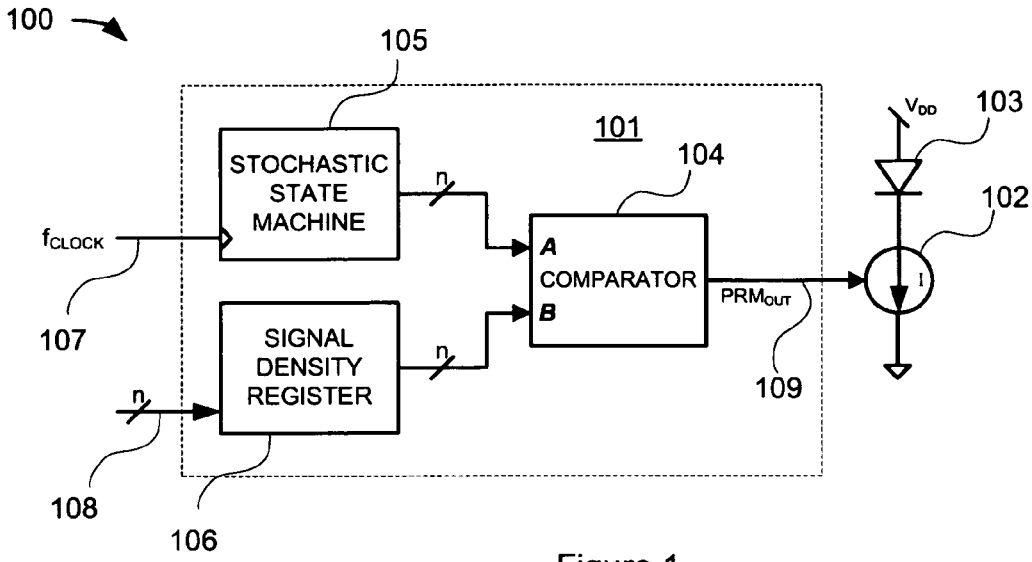
FIG. 1 illustrates one embodiment of a stochastic signal density modulator for dimming control of an optical transducer.

FIG. 1 is a block diagram 100 illustrating stochastic signal density modulation of an LED in one embodiment. FIG. 1 includes a stochastic signal density modulator (SSDM) 101 that is coupled to a controllable current supply 102 and drives an LED 103. The SSDM 101 includes an n-bit stochastic state machine 105, coupled to a first input of an n-bit comparator 104. SSDM 101 also includes an n-bit signal density register 106, coupled to a second input of n-bit comparator 104. Signal density register 106 may be any type of programmable register or latch as is known in the art.

In one embodiment, stochastic state machine 105 is clocked by clock signal $f_{CLOCK}$ on line 107 and generates an n-bit pseudorandom binary number between 0 and $2^n-1$ on each clock cycle. The signal density register 106 is loaded with an n-bit binary value on input line 108 between 0 and $2^n-1$ corresponding to a signal density between 0 and 100% as described below. The signal density value in signal density register 106 is compared in comparator 104 with the output of stochastic state machine 105. When the output value of stochastic state machine 105 is greater than the value in the signal density register 106, the output of comparator 104 is in a first state (e.g., high). When the output value of stochastic state machine 105 is at or below the value in the signal density register, the output of the comparator 104 is in a second state (e.g., low). The output values of stochastic state machine 105 forms a stationary pseudorandom process with a uniform probability distribution over the binary number space from 0 to $2^n-1$. Therefore, if the value in the signal density register 106 is m (where $0<m<2^n-1$), the output of stochastic state machine 105 will be below m for $m/(2^n-1)$ percent of the time and above m for $1-m/(2^n-1)$ percent of the time. As a result, the output 109 of comparator 104 will be in the first state for $m/(2^n-1)$ percent of the time and in the second state for $1-m/(2^n-1)$ percent of the time, but with a pseudorandom distribution.

Therefore, the output 109 of comparator 104 is a pseudorandom modulation (PRM) which drives the controllable current supply 102. When the PRM is in the first state, the controllable current supply 102 is on and the current through LED 103 is I. When the PRM is in the second state, the controllable current supply 102 is off and the current through LED 103 is zero (it will be appreciated that in other embodiments, current supply 102 may switch between two non-zero current states).

Figure 2:
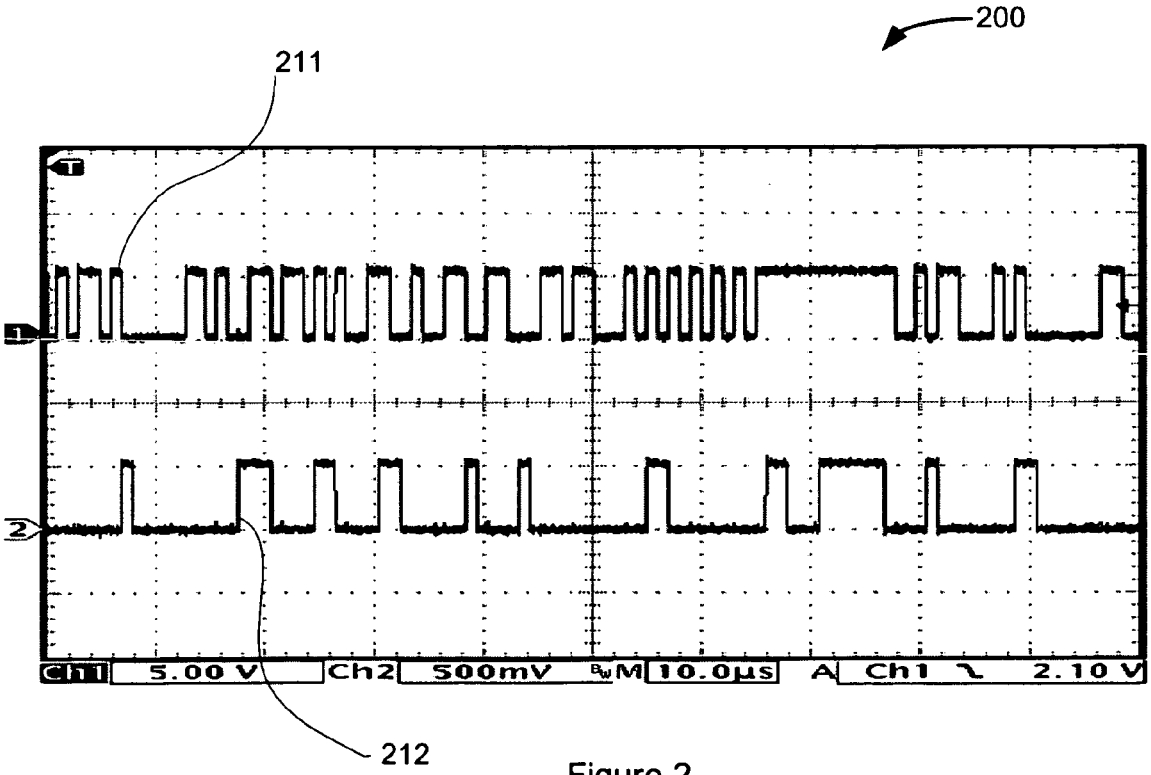
FIG. 2 illustrates two waveforms corresponding to two different stochastic signal densities in one embodiment.
Figure 3:
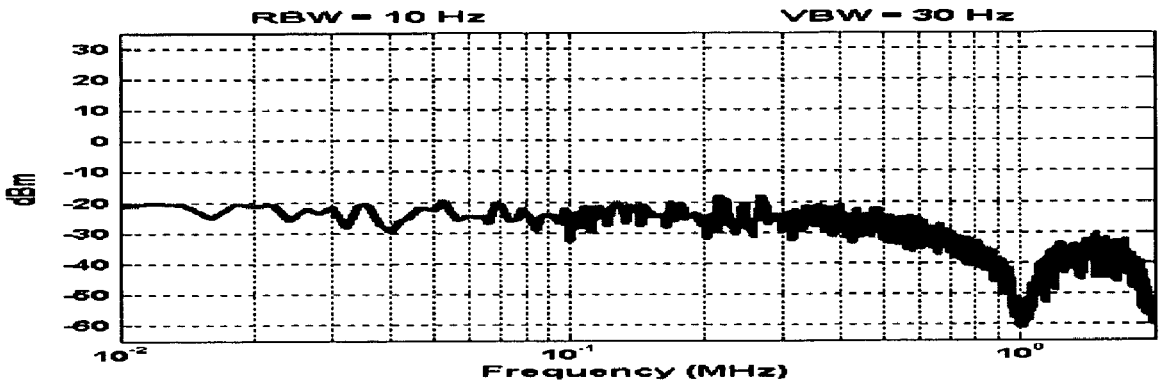
FIG. 3 illustrates the spectral signature of one embodiment of stochastic signal density modulation.
Figure 4:
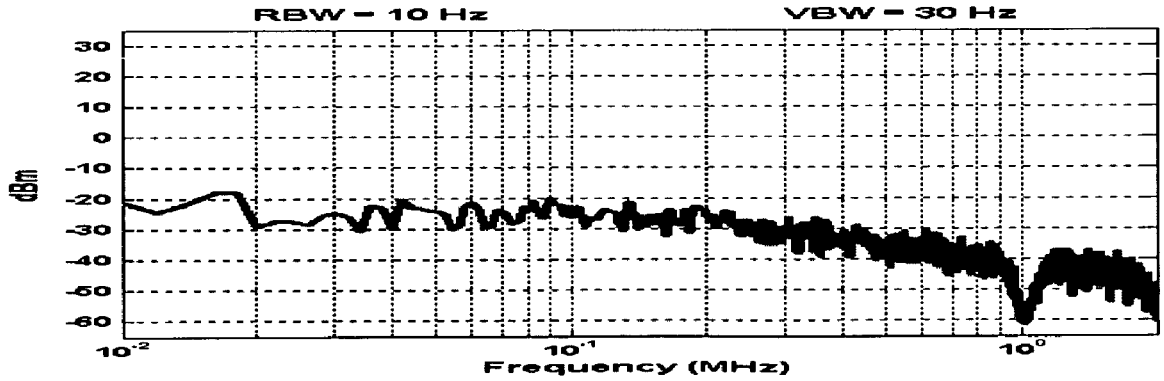
FIG. 4 illustrates the spectral signature of another embodiment of stochastic signal density modulation.

FIG. 2 is an oscillograph 200 illustrating the current through LED 103 in one embodiment for two different values of signal density. The upper trace 211 illustrates the LED current for a signal density of 50% and the lower trace 212 illustrates the LED current for a signal density of 14%. It can be seen that in this embodiment the waveforms are non-periodic in the measurement interval and do not have a uniform frequency. As a result, their respective spectra will be distributed and have no discrete spectral lines. FIG. 3 illustrates the modulation spectrum 300 corresponding to a 50% signal density for n=8 and $f_{CLOCK}$=1 MHz. FIG. 4 illustrates the modulation spectrum 400 corresponding to a 14% signal density for n=8 and $f_{CLOCK}$=1 MHz. It can be seen that both spectra 300 and 400 contain no sharp spectral lines, that the peak response of these spectrum 300 is approximately 30 dB below the peak of the corresponding PWM spectrum (FIG. 3), and that the frequency centroid of spectrum 300 is an order of magnitude greater than the corresponding PWM spectrum. The absence of spectral peaks and the increase in frequency (which allows for more effective filtering) reduces EMI content relative to uniform frequency modulation/

Stochastic state machine 105 may be embodied in a variety of ways. In one embodiment, stochastic state machine 105 may be a stochastic counter such as a pseudorandom number. In certain embodiments, a pseudorandom number generator may be implemented, for example, as an n-bit linear feedback shift register as is known in the art. In other embodiments, n separate n-bit linear feedback shift registers may be used in parallel to generate pseudorandom numbers. In other embodiments, stochastic state machine 105 may be a processing device having memory to hold data and instructions for the processing device to generate pseudorandom numbers.

In other embodiments, stochastic state machine 105 may be a true random number generator based on a random process such as thermionic emission of electrons or radioactive decay of alpha or beta particles.

In FIG. 1, the anode of LED 103 is coupled to a positive voltage supply $V_{DD}$ and the cathode of LED 103 is coupled to current supply 102, which is in turn coupled to ground, such that current supply 102 sinks current from LED 103. In other embodiments, the relative positions of current supply 102 and LED may be reversed such that the cathode of LED 103 is coupled to ground and the current supply 102 is coupled to the positive voltage supply, so that current supply 102 sources current to LED 103. In yet other embodiments, the positive voltage supply may be replaced with a ground connection and the ground connection may be replaced with a negative voltage supply.

Figure 5:
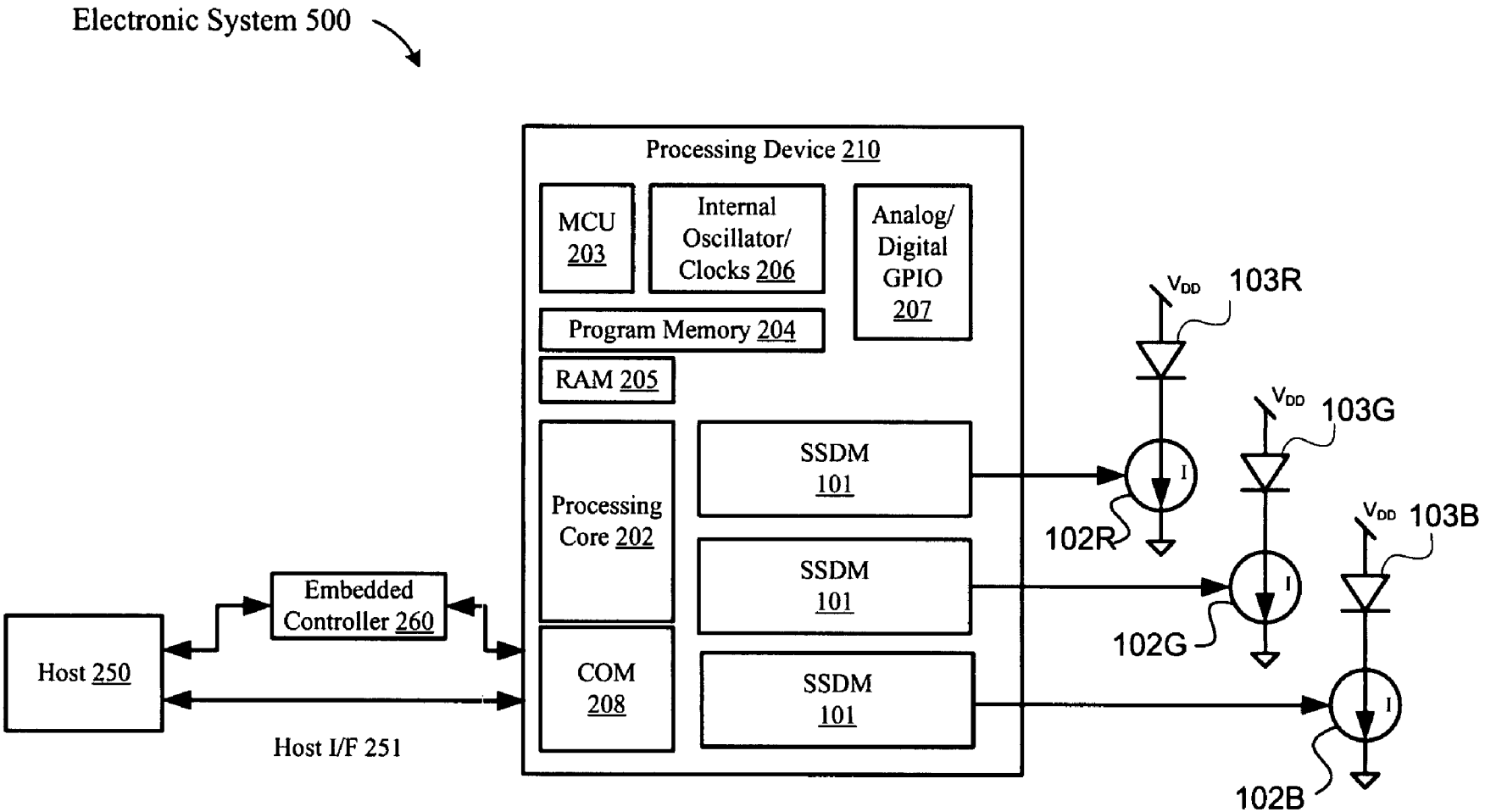
FIG. 5 illustrates an electronic system for stochastic signal density modulation of optical transducers in one embodiment.

FIG. 5 illustrates a block diagram of one embodiment of an electronic system 500 in which embodiments of the present invention may be implemented. Electronic system 500 includes processing device 210 and may include one or more arrays of LEDs. In one embodiment, electronic system 500 includes an array of RGB LEDs including red LED 103R, green LED 103G and blue LED 103B and their corresponding controllable current supplies 102R, 102G and 102B. Electronic system 500 may also include a host processor 250 and an embedded controller 260. The processing device 210 may include analog and/or digital general purpose input/output ("GPIO") ports 207. GPIO ports 207 may be programmable. GPIO ports 207 may be coupled to a Programmable Interconnect and Logic ("PIL"), which acts as an interconnect between GPIO ports 207 and a digital block array of the processing device 210 (not illustrated). The digital block array may be configured to implement a variety of digital logic circuits (e.g., DAC, UARTs, timers, etc.) using, in one embodiment, configurable user modules ("UMs"). The digital block array may be coupled to a system bus (not illustrated). Processing device 210 may also include memory, such as random access memory (RAM) 205 and program memory 204. RAM 205 may be static RAM (SRAM), dynamic RAM (DRAM) or any other type of random access memory. Program memory 204 may be any type of non-volatile storage, such as flash memory for example, which may be used to store firmware (e.g., control algorithms executable by processing core 202 to implement operations described herein). Processing device 210 may also include a memory controller unit (MCU) 203 coupled to memory and the processing core 202.

The processing device 210 may also include an analog block array (not illustrated). The analog block array is also coupled to the system bus. The analog block array also may be configured to implement a variety of analog circuits (e.g., ADC, analog filters, etc.) using, in one embodiment, configurable UMs. The analog block array may also be coupled to the GPIO 207.

As illustrated in FIG. 5, processing device 210 may be configured to control color mixing. Processing device 210 may include multiple stochastic signal density modulators (SSDM) 101 as described above, which are connected to current supplies 102R, 102G and 102B for the control of LEDs 103R, 103G and 103B, which may be red, green and blue LEDs, respectively. Alternatively, LEDs 103R, 103G and 103B may be combinations of other primary, secondary and/or complementary colors.

Processing device 210 may include internal oscillator/clocks 206 and communication block 208. The oscillator/clocks block 206 provides clock signals to one or more of the components of processing device 210. Communication block 208 may be used to communicate with an external component, such as host processor 250, via host interface (I/F) line 251. Alternatively, processing device 210 may also be coupled to embedded controller 260 to communicate with the external components, such as host 250. Interfacing to the host 250 can be achieved through various methods. In one exemplary embodiment, interfacing with the host 250 may be done using a standard PS/2 interface to connect to an embedded controller 260, which in turn sends data to the host 250 via low pin count (LPC) interface. In another exemplary embodiment, interfacing may be done using a universal serial bus (USB) interface directly coupled to the host 250 via host interface line 251. Alternatively, the processing device 210 may communicate to external components, such as the host 250 using industry standard interfaces, such as USB, PS/2, inter-integrated circuit (I2C) bus, or system packet interfaces (SPI). The host 250 and/or embedded controller 260 may be coupled to the processing device 210 with a ribbon or flex cable from an assembly, which houses the sensing device and processing device.

In other words, the processing device 210 may operate to communicate data (e.g., commands or signals to control the absolute and/or relative intensities of LEDs 103R, 103G and 103B)) using hardware, software, and/or firmware, and the data may be communicated directly to the processing device of the host 250, such as a host processor, or alternatively, may be communicated to the host 250 via drivers of the host 250, such as OS drivers, or other non-OS drivers. It should also be noted that the host 250 may directly communicate with the processing device 210 via host interface 251.

Processing device 210 may reside on a common carrier substrate such as, for example, an integrated circuit (IC) die substrate, a multi-chip module substrate, or the like. Alternatively, the components of processing device 210 may be one or more separate integrated circuits and/or discrete components. In one exemplary embodiment, processing device 210 may be a Programmable System on a Chip (PSoC™) processing device, manufactured by Cypress Semiconductor Corporation, San Jose, Calif. Alternatively, processing device 210 may be one or more other processing devices known by those of ordinary skill in the art, such as a microprocessor or central processing unit, a controller, special-purpose processor, digital signal processor (DSP), an application specific integrated circuit (ASIC), a field programmable gate array (FPGA), or the like. In an alternative embodiment, for example, the processing device may be a network processor having multiple processors including a core unit and multiple microengines. Additionally, the processing device may include any combination of general-purpose processing device(s) and special-purpose processing device(s).

SSDM 101 may be integrated into the IC of the processing device 210, or alternatively, in a separate IC. Alternatively, descriptions of SSDM 101 may be generated and compiled for incorporation into other integrated circuits. For example, behavioral level code describing SSDM 101, or portions thereof, may be generated using a hardware descriptive language, such as VHDL or Verilog, and stored to a machine-accessible medium (e.g., CD-ROM, hard disk, floppy disk, etc.). Furthermore, the behavioral level code can be compiled into register transfer level ("RTL") code, a netlist, or even a circuit layout and stored to a machine-accessible medium. The behavioral level code, the RTL code, the netlist, and the circuit layout all represent various levels of abstraction to describe SSDM 101.

It should be noted that the components of electronic system 500 may include all the components described above. Alternatively, electronic system 500 may include only some of the components described above.

While embodiments of the invention have been described in terms of operations with or on binary numbers, such description is only for ease of discussion. It will be appreciated that embodiments of the invention may be implemented using other types of numerical representations such as decimal, octal, hexadecimal, BCD or other numerical representation as is known in the art.

Embodiments of the present invention, described herein, include various operations. These operations may be performed by hardware components, software, firmware, or a combination thereof. Any of the signals provided over various buses described herein may be time multiplexed with other signals and provided over one or more common buses. Additionally, the interconnection between circuit components or blocks may be shown as buses or as single signal lines. Each of the buses may alternatively be one or more single signal lines and each of the single signal lines may alternatively be buses.

Certain embodiments may be implemented as a computer program product that may include instructions stored on a machine-readable medium. These instructions may be used to program a general-purpose or special-purpose processor to perform the described operations. A machine-readable medium includes any mechanism for storing or transmitting information in a form (e.g., software, processing application) readable by a machine (e.g., a computer). The machine-readable medium may include, but is not limited to, magnetic storage medium (e.g., floppy diskette); optical storage medium (e.g., CD-ROM); magneto-optical storage medium; read-only memory (ROM); random-access memory (RAM); erasable programmable memory (e.g., EPROM and EEPROM); flash memory; electrical, optical, acoustical, or other form of propagated signal (e.g., carrier waves, infrared signals, digital signals, etc.); or another type of medium suitable for storing electronic instructions.

Additionally, some embodiments may be practiced in distributed computing environments where the machine-readable medium is stored on and/or executed by more than one computer system. In addition, the information transferred between computer systems may either be pulled or pushed across the communication medium connecting the computer systems.

Although the operations of the method(s) herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative sense rather than a restrictive sense.

What is claimed is:

1. An apparatus, comprising:

a controllable current supply coupled to a light-emitting diode;

a stochastic signal density modulator (SSDM) coupled to the controllable current supply, wherein the SSDM is configured to provide a stochastic control signal to the controllable current supply, to control a light intensity output of the light-emitting diode and to reduce electromagnetic interference, wherein the SSDM comprises:

a signal density register configured to store a signal density value, wherein the stochastic control signal has a signal density corresponding to the stored signal density value.

2. The apparatus of claim 1, wherein the SSDM further comprises:

a comparator comprising a first input, a second input and an output;

a stochastic state machine, coupled to the first input of the comparator, wherein the stochastic state machine is configured to generate a plurality of stochastic values, wherein the signal density register is coupled to the second input of the comparator, and wherein the output of the comparator is a first output value if a stochastic value of the plurality of stochastic values is greater than the signal density value and wherein the output of the comparator is a second output value if the stochastic value of the plurality of stochastic values is less than or equal to the signal density value.

3. The apparatus of claim 2, wherein the stochastic state machine comprises a stochastic counter.

4. The apparatus of claim 3, wherein the stochastic counter comprises a random number generator.

5. The apparatus of claim 3, wherein the stochastic counter comprises a pseudorandom number generator.

6. The apparatus of claim 2, wherein the stochastic state machine includes a machine-readable medium containing data that, when read by the stochastic state machine, causes the stochastic state machine to perform operations comprising generating a sequence of pseudorandom numbers.

7. The apparatus of claim 2, wherein the signal density register comprises a programmable register.

8. The apparatus of claim 2, wherein the controllable current supply is configured to provide a first current level when the output of the comparator is the first output value and to provide a second current level when the output of the comparator is the second output value.

9. The apparatus of claim 8, wherein the first current level comprises a non-zero current level and the second current level is approximately zero.

10. The apparatus of claim 9, wherein the second current level comprises a non-zero current level and the first current level is approximately zero.

11. The apparatus of claim 1, wherein the light-emitting diode comprises an anode and a cathode, wherein a first terminal of the switched current supply is coupled to the anode, and wherein the current supply is configured to source current to the light-emitting diode.

12. The apparatus of claim 11, wherein the cathode of the light-emitting diode is coupled to a first voltage, wherein a second terminal of the current supply is coupled to a second voltage, and wherein the second voltage is positive with respect to the first voltage.

13. The apparatus of claim 1, wherein the light-emitting diode comprises an anode and a cathode, wherein a first terminal of the switched current supply is coupled to the cathode, and wherein the current supply is configured to sink current from the light-emitting diode.

14. The apparatus of claim 13, wherein the anode of the light-emitting diode is coupled to a first voltage, wherein a second terminal of the current supply is coupled to a second voltage, and wherein the first voltage is positive with respect to the second voltage.

15. A method for controlling a light source with reduced electromagnetic interference, the method comprising:

providing a controllable current for one or more light emitting diodes; and stochastically controlling the current to select a light intensity output from the one or more light emitting diodes resulting in reduced electromagnetic interference, wherein stochastically controlling the current comprises generating a stochastic signal density modulation signal having a signal density based on a programmed number representing the signal density.

16. The method of claim 15, wherein stochastically controlling the current further comprises:

comparing the state of a stochastic state machine to the programmed number to generate the stochastic signal density modulation signal;

generating the stochastic signal density modulation signal; and modulating the controllable current with the stochastic signal density modulation signal.

17. The method of claim 16, wherein generating the stochastic signal density modulation signal comprises:

comparing a plurality of stochastic values from the stochastic state machine with the programmed number representing the signal density of the stochastic signal density modulation signal;

generating a pulse train to control the controllable current, the pulse train having a first pulse amplitude if a stochastic value of the plurality of stochastic values is greater than the programmed number and having a second pulse amplitude if the stochastic value of the plurality of stochastic values is less than or equal to the programmed number.

18. The method of claim 17, wherein the stochastic state machine comprises a random number generator, wherein the plurality of stochastic values comprises a plurality of random numbers.

19. The method of claim 17, wherein the stochastic state machine comprises a pseudorandom number generator, wherein the plurality of stochastic values comprises a plurality of pseudorandom numbers.

20. The method of claim 19, further comprising programming the number representing the signal density of the stochastic signal density modulation signal in a programmable register.

21. The method of claim 17, further comprising:

providing a first current level to the light-emitting diode when the pulse train has the first pulse amplitude; and providing a second current level to the light-emitting diode when the pulse train has the second pulse amplitude.

22. The method of claim 21, wherein the first current level comprises a non-zero current level and the second current level is approximately zero.

23. The method of claim 21, wherein the second current level comprises a non-zero current level and the first current level is approximately zero.

24. An apparatus, comprising;

means for increasing a dimming frequency of a dimming signal for an optical transducer comprising means for generating a stochastic signal density modulation signal; and means for controlling the optical transducer with the dimming signal comprising means for modulating a controllable current for the transducer with a stochastic signal density modulation signal with a frequency greater than uniform frequency modulation and free of spectral peaks such that the control signal has a reduced electromagnetic interference content relative to uniform frequency modulation.

25. A system, comprising:

a plurality of controllable current supplies coupled to a plurality of optical transducers; and a plurality of controllers coupled to the plurality of controllable current supplies, wherein each controller of the plurality of controllers is configured to provide a stochastic control signal to one of the controllable current supplies, the stochastic control signal having a selected stochastic signal density to control a light intensity output of one of the plurality of optical transducers.

26. The system of claim 25, wherein the plurality of optical transducers comprises a set of primary color optical transducers and wherein the plurality of controllers is configured to control a color mix of the plurality of optical transducers.

27. The system of claim 25, wherein the plurality of optical transducers comprises a set of secondary color optical transducers and wherein the plurality of controllers is configured to control a color mix of the plurality of optical transducers.

28. The system of claim 25, wherein the plurality of optical transducers comprises a set of complementary color optical transducers and wherein the plurality of controllers is configured to control a color mix of the plurality of optical transducers.

* * * * *